US007581281B2

(12) United States Patent
Schlapkohl

(10) Patent No.: US 7,581,281 B2
(45) Date of Patent: Sep. 1, 2009

(54) ULTRA-COMPACT RECESSED WALL MOUNTED VACUUM CLEANER

(76) Inventor: Peter Schlapkohl, 2939 SW. 42nd Ave., Palm City, FL (US) 34990

( * ) Notice: Subject to any disclaimer, the term of this patent is extended or adjusted under 35 U.S.C. 154(b) by 757 days.

(21) Appl. No.: 11/072,684

(22) Filed: Mar. 4, 2005

(65) Prior Publication Data

US 2006/0196002 A1 Sep. 7, 2006

(51) Int. Cl.
*A47L 9/00* (2006.01)

(52) U.S. Cl. ..... 15/301; 15/324; 15/326

(58) Field of Classification Search ..... 15/324, 15/326, 301; *A47L 9/00*
See application file for complete search history.

(56) References Cited

U.S. PATENT DOCUMENTS 3,783,472 A 1/1974 Mol
4,617,034 A 10/1986 Ikezaki
4,970,753 A 11/1990 Herron, Jr.
5,293,664 A 3/1994 Lim et al.
6,158,080 A 12/2000 Schlapkohl
6,530,116 B2 * 3/2003 Berfield et al. ..... 15/328

FOREIGN PATENT DOCUMENTS

EP 461443 A1 12/1991
WO 2006096309 9/2006

* cited by examiner

*Primary Examiner*—David A Redding
(74) *Attorney, Agent, or Firm*—McHale & Slavin, P.A.

(57) ABSTRACT

An improved wall-mounted recessed vacuum cleaner system incorporates vibration dampening mounts between the motor and the outer housing, air channels within the housing to smooth air flow and reduced number of parts to significantly reduce the noise level during operation. The vacuum cleaner incorporates an extremely compact housing and motor design with a filtering debris receptacle arranged directly over the motor compartment.

9 Claims, 7 Drawing Sheets

ULTRA-COMPACT RECESSED WALL MOUNTED VACUUM CLEANER

BACKGROUND OF THE INVENTION

1. Field of the Invention

This invention relates to the field of wall mounted vacuum cleaners and particularly to an improved self-contained unit capable of being totally recessed within an interior wall and operating with a greatly reduced noise level.

2. Background of the Invention

Central vacuum cleaning systems are useful in homes, offices and commercial establishments. These systems generally utilize a unitary centrally located station containing a vacuum supply, a collection receptacle and a plurality of conduits which interconnect various parts of the structure to the central station. The conduits normally terminate in a hose adapter coupling enabling each area to be cleaned by inserting the hose assembly into the hose coupling and activating the central station vacuum supply. The hose assembly is normally moved from one room to another. In some systems the hose coupling also supplies electrical power to a brushing system, sometimes referred to as a powerhead.

These systems suffer from the fact that an extremely powerful unit must be utilized in order to compensate for the pressure drop experienced in traversing the various heights and bends needed to route the conduit through the walls of the structure. Furthermore, prior art central vacuum systems have historically been limited to inclusion in only new construction since it is both difficult and costly to install the necessary conduits in existing structures.

In addition, as the air filtering and residue collecting receptacle becomes filled, there is a tendency for the airflow around it to be impaired as it presses against the inner walls of its housing. The instant invention incorporates a unique baffle assembly which advantageously lines the inner walls of the housing around the collection receptacle and maintains an unimpeded flow path so as to insure optimum operation, even as the receptacle becomes filled.

Wall recessed cleaning systems are known that are self-contained so as to include the vacuum supply, vacuum bag and hose receptacle in a single unit, adapted to be situated within an opening prepared in the wall of an existing structure. The problem with such prior art devices was that they were difficult to install within an interior wall recess since they were greater than 6 inches in depth. Another problem was that the geometry of the motor structure necessitated use of an inefficient flow pattern in order to reduce the unit's overall dimensions.

U.S. Pat. No. 6,158,080 to Schlapkohl, the inventor of the instant improvement, is incorporated herein by reference. The patent teaches the provision of a small, compact, powerful, self-contained, wall mounted central vacuum system. The vacuum cleaner has a housing that encloses the air filtering and residue collection chamber together with the motor producing the air flow. The residue collection chamber is designed to incorporate easily removable and disposable bags. The housing includes hardware for mounting the vacuum cleaner on or recessed in a wall along with inlet and exhaust openings. The vacuum cleaner can simultaneously provide powerful and reliable cleaning without loss of efficiency as debris is collected.

Because the vacuum cleaner is mounted on or in a wall, all vibrations and noise, are transmitted directly to the wall structure and disseminate throughout the larger enclosure. Therefore, an improved self-contained wall mounted vacuum cleaner that has a significantly reduced noise level is desired.

SUMMARY OF THE INVENTION

It is an objective of this invention to provide a self-contained, wall mounted, powerful, vacuum cleaner with a very low noise level during operation.

It is another objective of this invention to provide a suspension system in the vacuum cleaner to isolate the pump and motor from the housing to reduce transfer of vibrations from the housing to the wall.

It is a further objective of this invention to provide internal channels in the housing to direct air flow smoothly and efficiently from the inlet to the outlet producing a low noise level.

It is yet another objective of this invention to provide a molded housing having very few separate parts thereby reducing vibration between components.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Figure 7:
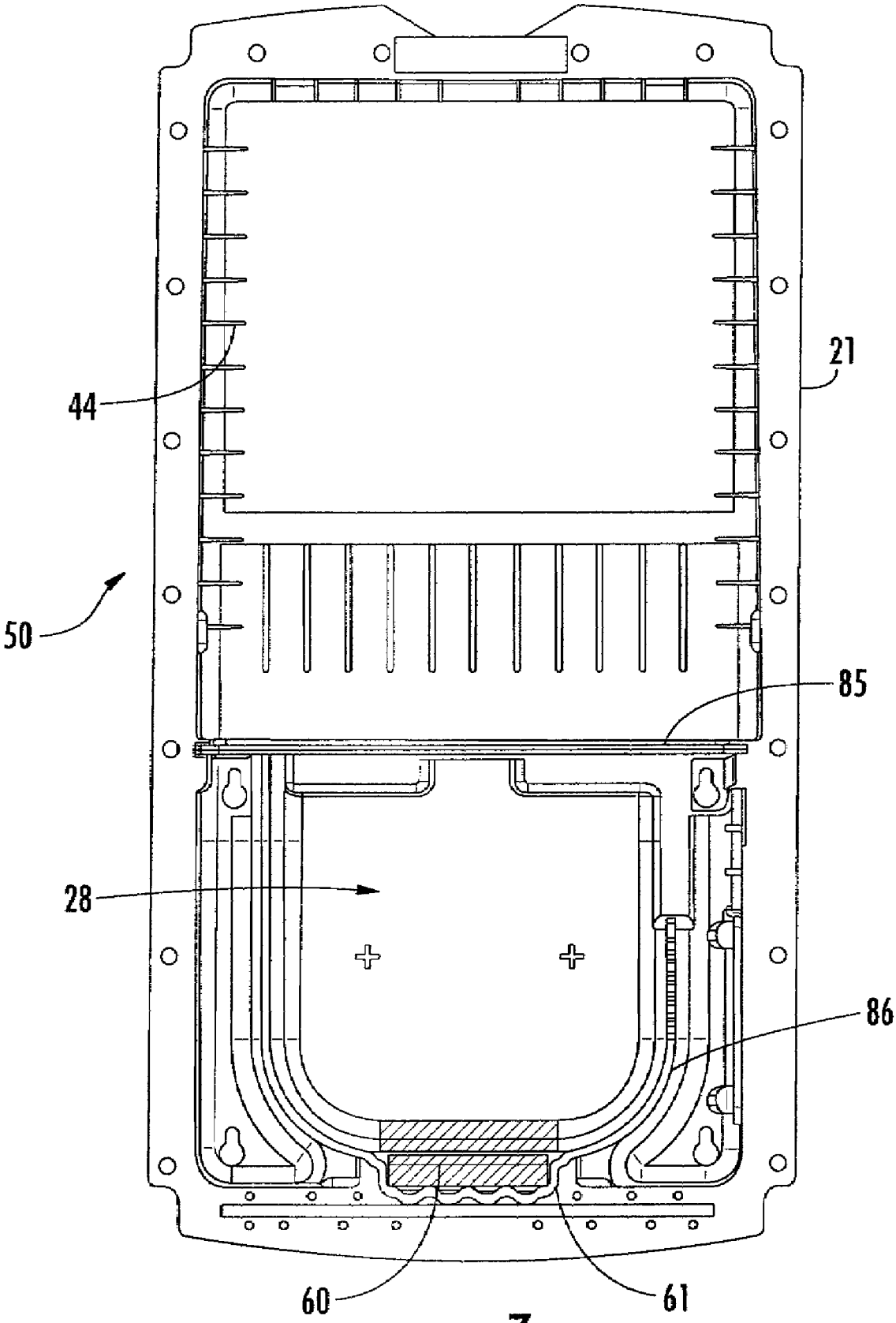
FIG. 7 is a plain view of the inside of the cover assembly.

The wall-mounted vacuum system of the instant invention is characterized by a front cover frame assembly 50 and an open faced housing 10. The open-faced rectangular housing 10 has a rear wall 12, two side walls 14, 14A, a top wall 16 and a bottom wall 18. The top wall and adjacent side walls each have a perpendicular flange 20 adjacent the front face thereof containing a series of spaced perforations 22. These perforations aid in the accurate positioning of the cover frame assembly 50 by accepting alignment tabs 52 which are molded about the perimeter of the rear side of the cover frame assembly. The front cover frame assembly 50 includes a flange 21, illustrated in FIG. 7. Flange 21 and flange 20 are constructed and arranged to provide a sealing engagement between the front cover frame assembly and housing 10. Alternatively, a seal (not shown) can be placed in between the flange 20 and flange 21 to provide a sealing engagement between the front cover assembly 50 and the housing 10. The system components are constructed and arranged so as to mount within the open-faced rectangular housing 10. The housing 10 and cover frame assembly 50 may be formed of stainless steel or galvanized sheet metal. Alternatively, they may be molded from ABS or polycarbonate/ABS blend.

The minimal depth of the housing 10 enables it to fit within the recess created when an opening is formed between the studs of a standard wall construction. A peripheral flange 20 extends perpendicularly from the sidewalls 14, 14A at the outermost edge thereof so as to provide a rigid surface for firmly positioning the housing adjacent to the wall face. The positioning of components and compact motor design result in the housing 10 having a depth of only 3⅞ inches. The arcuate projection of the front cover frame 50 adds 13/16 inch resulting in a device having a total depth of only 4 11/16 inches. The minimal depth required for installation permits placement of the unit in any partition structure, for example gypsum board walls, plaster walls, and fiberglass or metal panels found in boats or recreational vehicles.

The open faced housing 10 has an upper containment compartment 26 and a lower evacuation compartment 28 separated by a partition assembly 24. The containment compartment 26 supports an air filtering and residue collecting receptacle, such as a removable vacuum bag 49, and a coupling adapter 74 to attach a vacuum hose (not shown) which communicates with the inside of the bag. The partition 24 has a thin extension 84 that projects beyond the side walls and fits within a transverse channel 85 in the cover frame assembly 50 to seal the containment compartment except for the central circular opening 43. This prevents entrained air from spilling over the partition 24 into the evacuation chamber 28 creating back pressure and vibration between the cover frame 50 and the housing 10.

The sidewalls 14, 14A have integral positioning members 44 which support the internal components while simultaneously insuring unimpeded airflow between the containment and evacuation compartments. These positioning members 44 may be in the form of upstanding ridges or alternatively may constitute channels which may be machined or molded into the sidewall construction thereby stiffening the wall structure and reducing vibration.

Figure 8A:
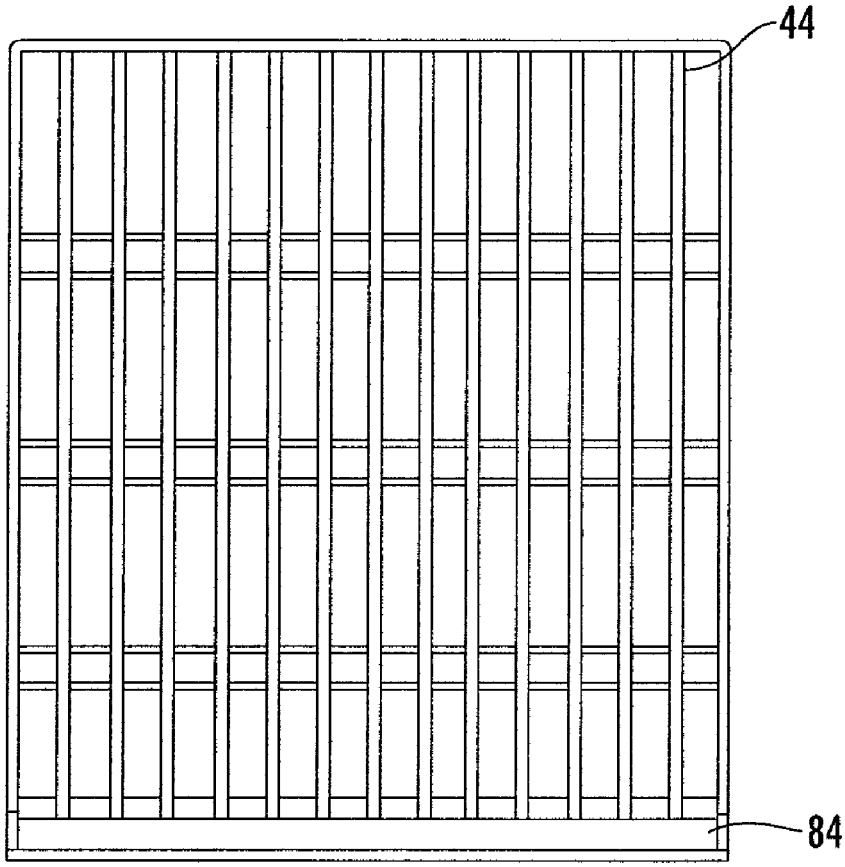
FIGS. 8*a*, 8*b*, and 8*c* are an orthographic projection view of a vertical baffle assembly.
Figure 8B:
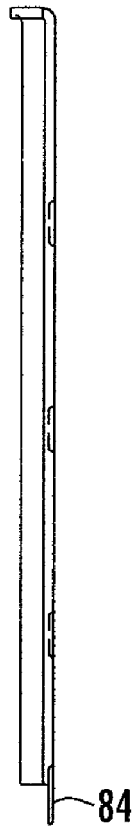
Figure 8C:
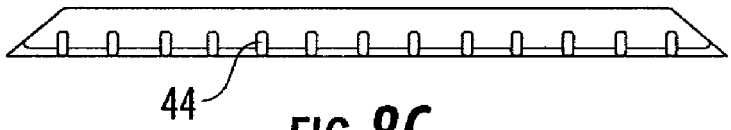

In order to prevent a reduction in the ability of air to flow through the system as debris collects within the receptacle a vertical baffle assembly, including positioning members 44, is molded or otherwise integrally attached in spaced relation to the rear wall 12 of the housing, also strengthening the housing 10. The positioning of these positioning members allows optimum air flow to be maintained between the containment chamber and the evacuation chamber, even as the collection receptacle becomes filled during use. The vertical baffle assembly can be in the form of a plurality of members which contain vertical ribs in spaced relation to the housing sidewalls and rear wall so as to thereby create an area for unrestricted air flow throughout the containment chamber, as illustrated in FIGS. 8A-C.

Figure 1:
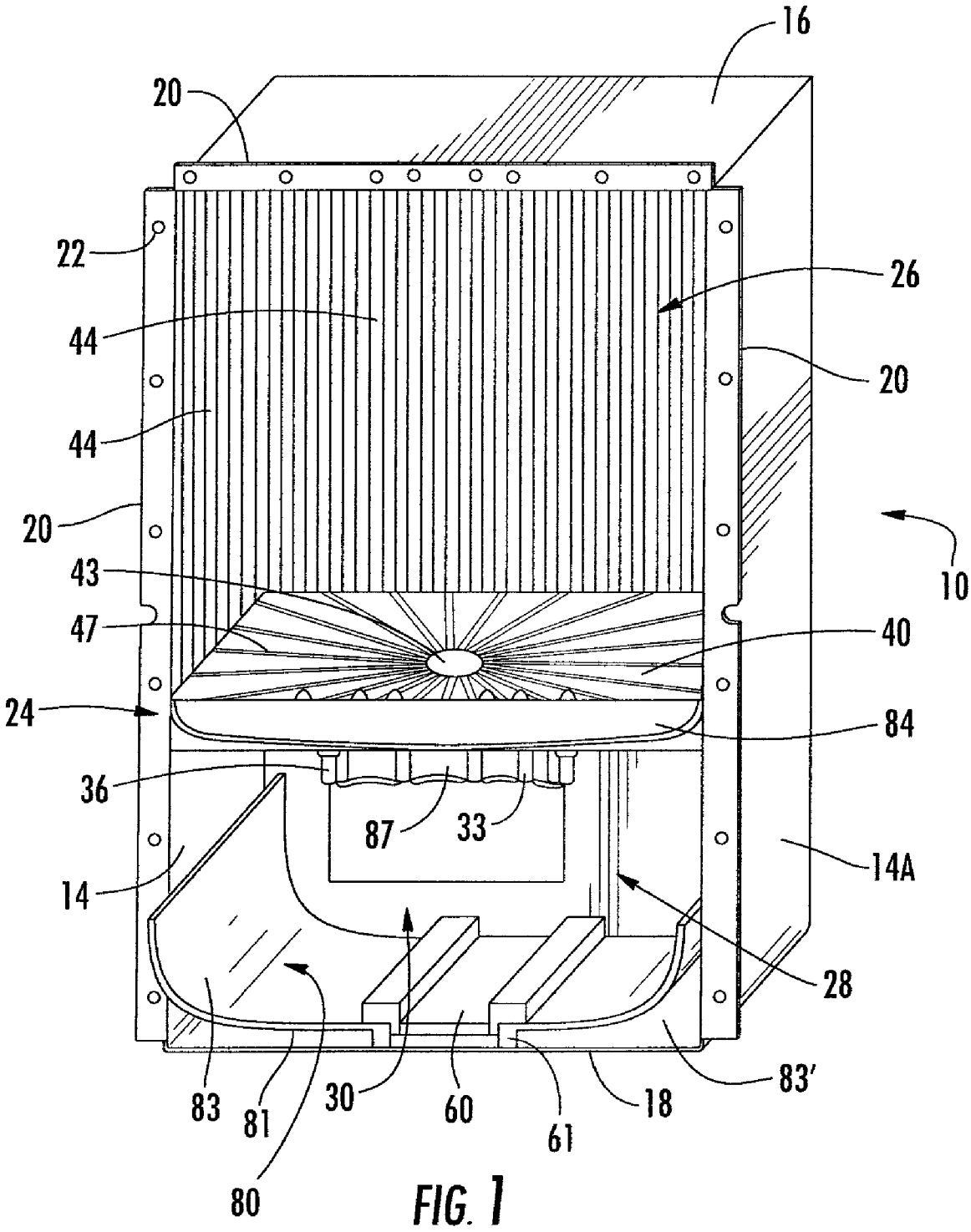
FIG. 1 is a front plan view of the vacuum system with the assembly removed.
Figure 3:
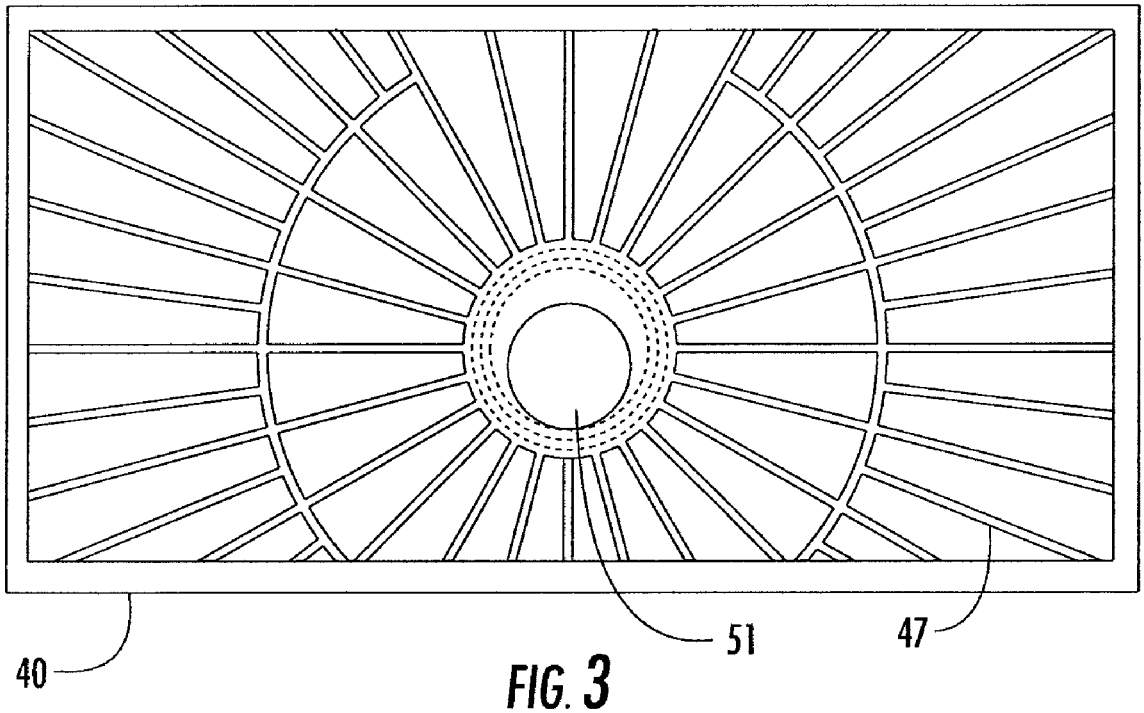
FIG. 3 is a top view of the supporting grid element.

Referring to FIGS. 1 and 3, supporting grid element 40, termed a bag grid, is positioned below the mesh filter element 38. This member, which in a preferred embodiment is formed from a flame retardant ABS resin, contains a plurality of baffles 47 circumferentially spaced about the central opening 43 and designed to provide rigid support for the overlying bag. As the bag fills with accumulated debris, there is a tendency for material to collect unevenly within the bag. The bag grid provides overall support along the bottom of the bag structure thereby preventing the mesh filter 38 from being deformed. By fully supporting the bag and preventing filter deformation, uniform flow rate is maintained throughout the vacuum cleaner assembly and efficient cleaning can be attained.

The chamber separating partition assembly 24 containing a bag supporting grid element, a motor protecting filter element and a motor shroud element, is situated between the motor and the air filtering and collection receptacle. The chamber separating assembly 24 serves a two-fold function. Firstly, the spaced relationship of the bag support grid element, motor protecting filter element and motor shroud provide support for the air filtration and debris collecting receptacle above the motor housing and help to insure a uniform and unimpeded flow of air to the suction fan and motor housing. Secondly, the underside of the motor shroud provides a downwardly directed member which frictionally engages the flow-thru motor assembly 30 so as to provide reliable and rigid support therefore.

During operation, the air flow through the opening 43 enters the evacuation chamber 28 coaxially with the motor and is directed outwardly toward the sides of the chamber. An air flow divider 80 is molded to the rear wall 12 and the bottom wall 18 of the evacuation compartment 28. The air flow divider 80 is a thin curved flange that extends beyond the side walls 14, 14A and terminates in an outermost edge 81. The outermost edge 81 cooperates with a curved channel 86 in the front cover frame 50 to subdivide the evacuation compartment into a central plenum 83 and an outer airway 83'. By separating the empty space of the plenum from the airway 83', a smooth air flow is formed eliminating noise producing turbulence in the plenum. The air flow curves downwardly and inwardly toward the bottom of the unit.

An air exhaust is located at the bottom of the unit. The exhaust is formed by an outlet grid 56 extending between the cover frame 50 and the housing 10. Because a portion of the air flow divider 80 extends past the side walls of the housing, the air flow is directed through the grid 56. A final filter 58 is supported by the grid. The filter prevents debris from re-entry into the room and further muffles the sound of the device.

The lower section or evacuation chamber 28 contains the flow-thru motor housing assembly 30 which is comprised of a compact flow-thru vacuum motor 32 which draws air therethrough so as to create an area of lower pressure within the containment chamber.

The bottom surface of the partition assembly 24 is defined by a motor shroud 36. The motor shroud contains an upstanding and generally circular flange adapted to frictionally engage the flow-thru motor assembly 30 so as to precisely position the source of vacuum beneath the shroud. Directly above the flow-thru motor assembly, the motor shroud contains a plurality of upstanding rigid members or baffles which are circumferentially spaced about a central circular member 43.

Figure 2A:
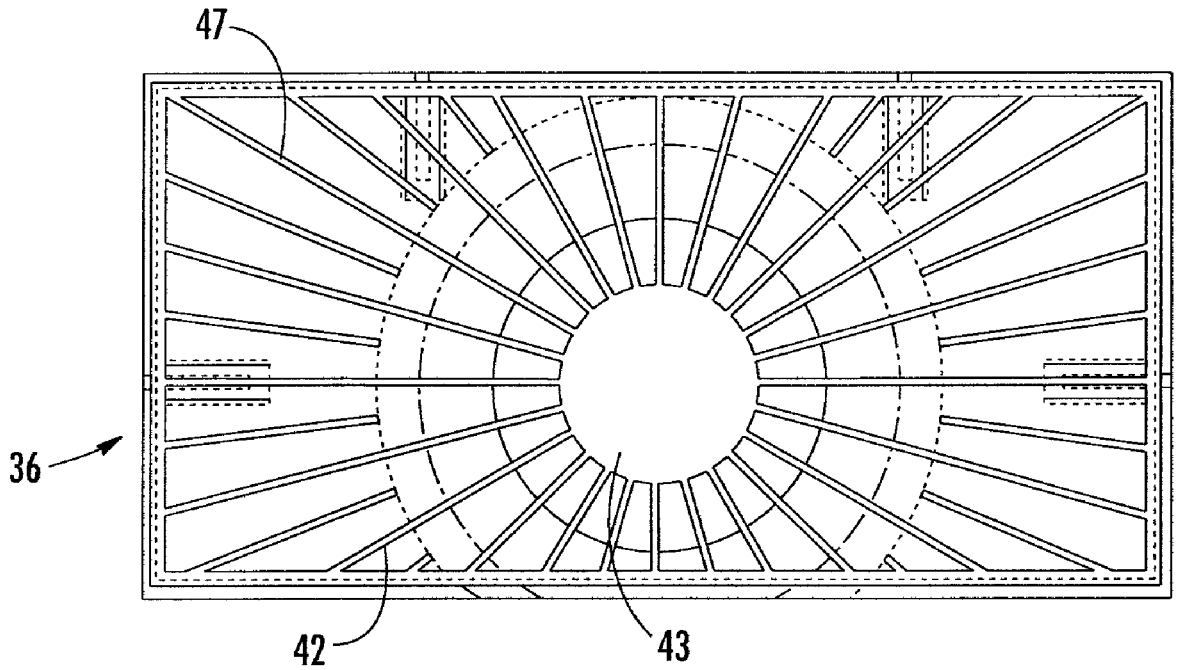
FIG. 2*a* is a top view of the motor shroud.
Figure 2B:
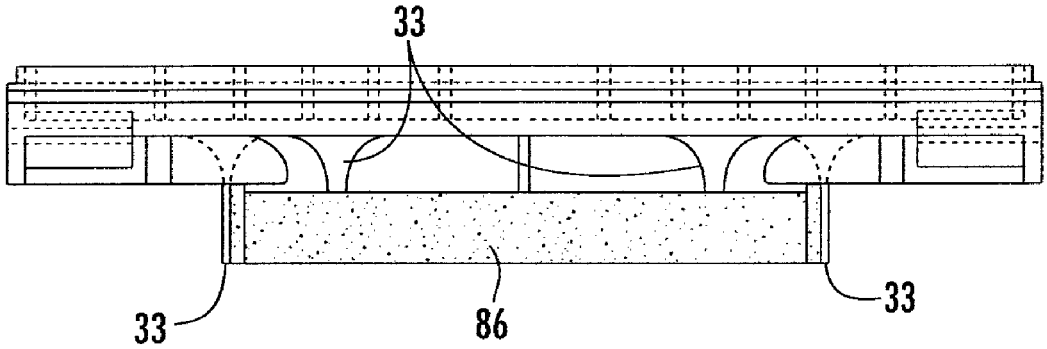
FIG. 2*b* is a front view of the motor shroud.

Referring to FIGS. 1, 2*a* and 2*b*, the motor shroud 36 is sized so as to completely fill the cross-sectional area of the housing above the motor assembly 30. The shroud is constructed and arranged so that the lowermost side includes plural molded members 33 to rigidly engage the motor housing assembly. In the preferred embodiment, an additional cushioning member, such as a thick rubber ring 87, positioned between the molded members 33 and the motor housing, can be utilized to dampen vibration between the shroud 36 and the housing 10 and to increase the frictional force which retains the motor assembly within the shroud. The resilient cushioning member may be discontinuous rather than a ring. Also, the air pervious foam 66 is wrapped about the motor to absorb the sound of the motor. The air transmission rate of the foam must be such that temperature build-up is prevented during operation.

The other end of the flow-through motor assembly is attached to a thick elastomeric shock absorber 60. The shock absorber 60 is held in a molded motor mount 61 formed as a part of the bottom wall 18 of the housing 10.

Thus the flow-through vacuum motor assembly 30 is isolated from the housing 10 and the front cover frame 50 by resilient vibration dampening elements at both ends of the motor. The elastomeric shock absorber and the thick rubber ring inside the shroud 36 deaden the vibration and resultant noise in the system producing a low noise operation.

Figure 4:
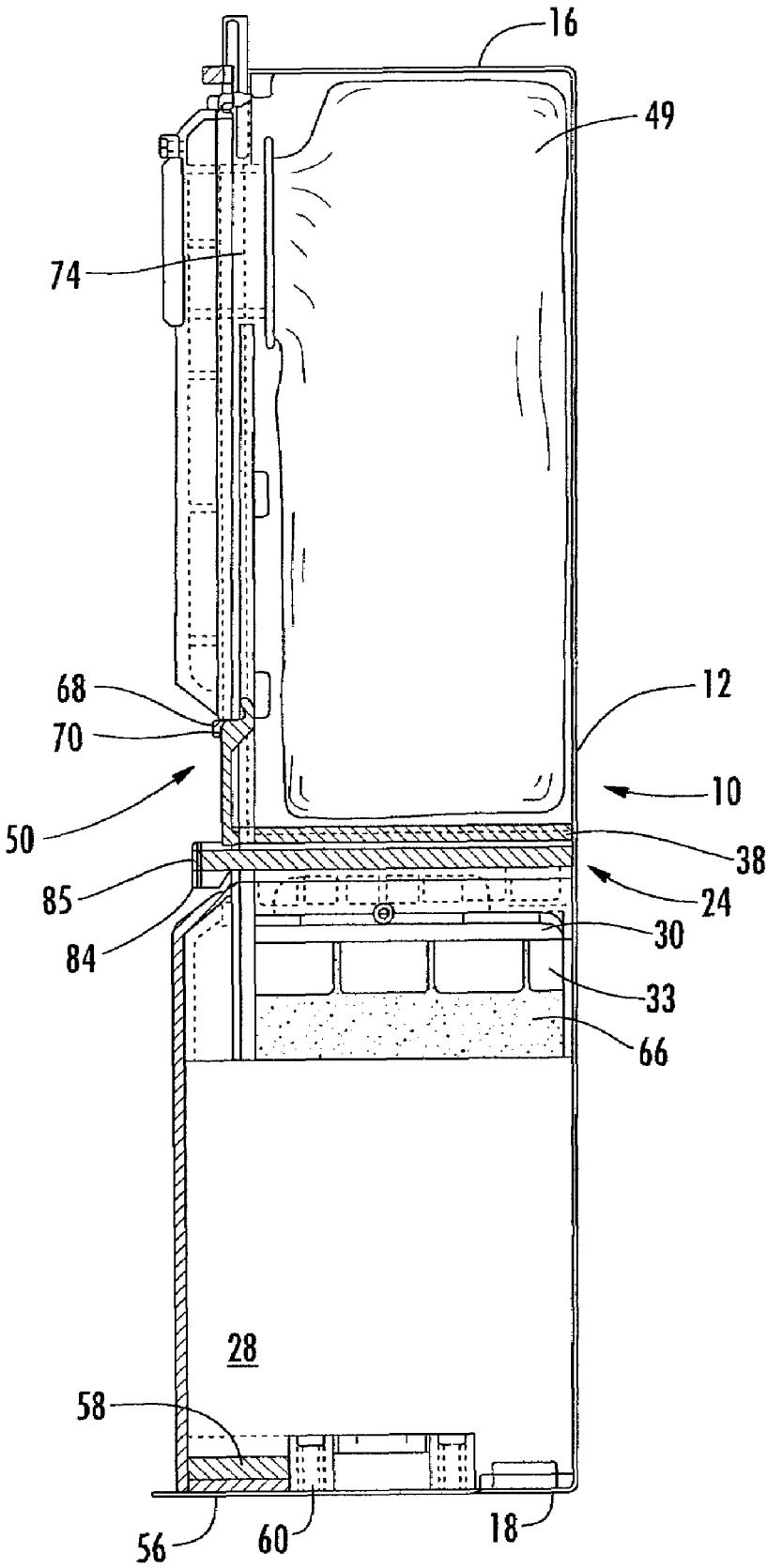
FIG. 4 is a side plan view of the vacuum system.
Figure 6:
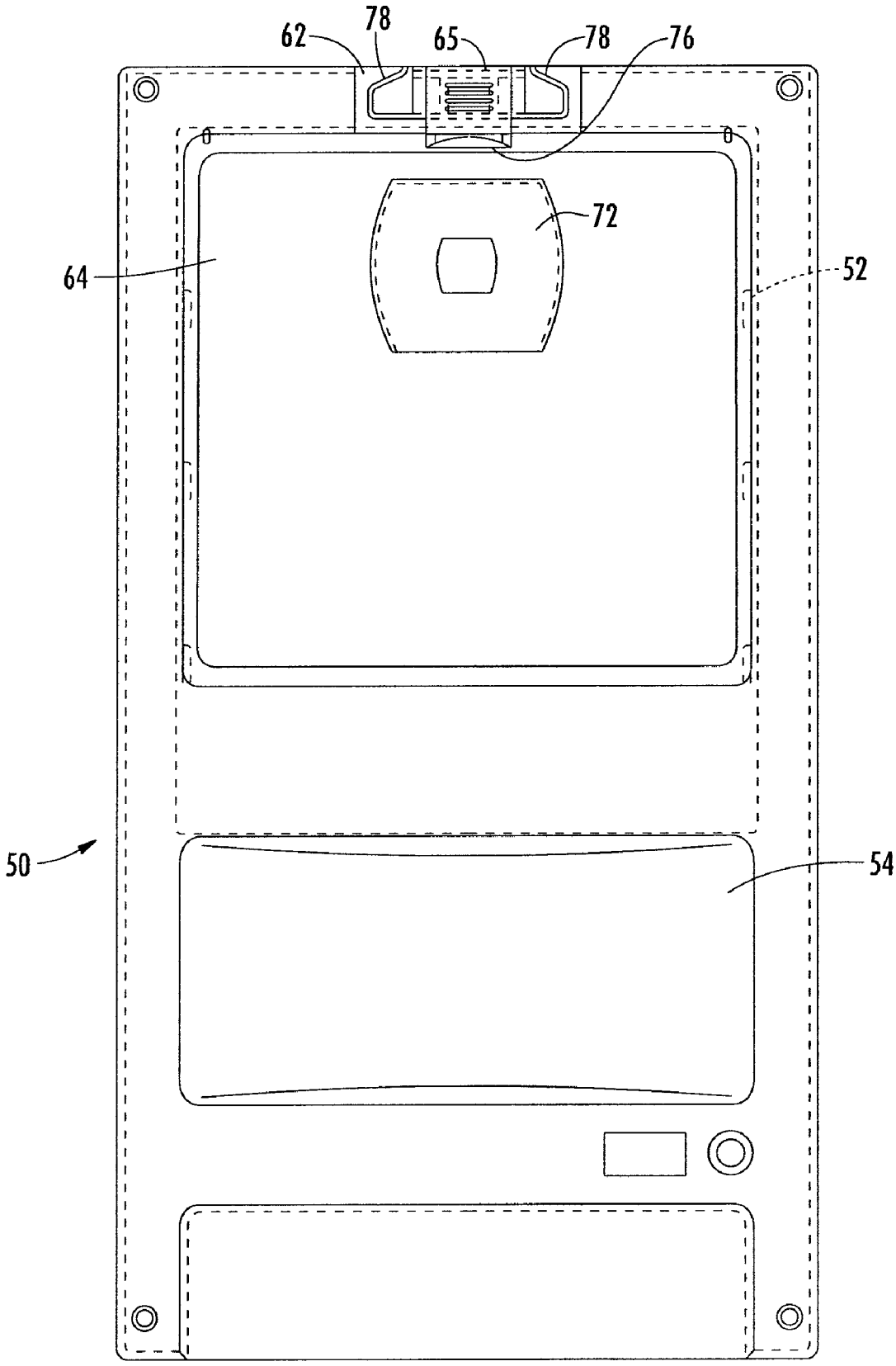
FIG. 6 is a front plan view of the cover assembly.

Referring to FIG. 4, a side plan view of the vacuum system is shown. The cover frame assembly 50 extends the full length of the housing. It contains a plurality of alignment tabs 52 which are adapted to be inserted within perforations 22 in peripheral flanges 20 (FIG. 1) thereby insuring precise positioning. The cover frame assembly contains an arcuate area 54 designed to accommodate the motor assembly 30.

Figure 5:
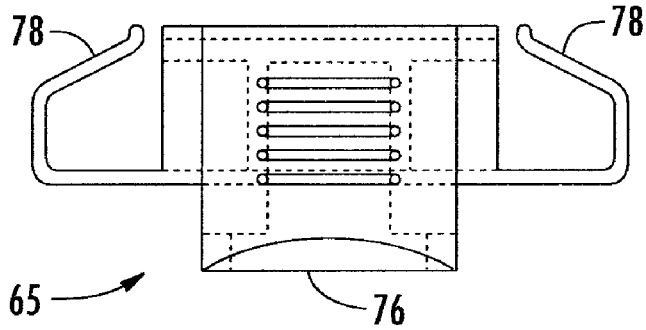
FIG. 5 is a front plan view of the access panel latch.

At the uppermost edge of the cover frame assembly, a latch receiving area 62 is formed which retains a molded latch 65 more particularly described in FIG. 5. The latch is capable of vertical reciprocating motion so as to enable it to secure the air collection and debris collecting or containment chamber access panel 64. Access panel 64 is formed with a small groove 66 along the perimeter of its rear face within which a resilient sealing member, e.g. an elastomeric O-ring (not shown) is positioned. Access panel 64 further contains an inlet cover 72 hingeably attached and juxtaposed to the vacuum hose coupling adapter 74, which is adapted on a first outer side thereof for fluid communication with a vacuum hose and further adapted, on a second inner side thereof, for fluid communication with an air filtration and debris collecting receptacle. The inlet cover is normally maintained flat against the access panel thereby sealing the coupling area when the vacuum is not in operation.

In an alternative embodiment, a T-coupling (not shown) may be substituted for the coupling adapter 74. In this case the access cover is sealed in the area of the inlet cover 72 and an alternative vacuum hose adapter coupling is included above the top wall and having a secondary conduit which extends to an adjacent room area. In such an embodiment, each vacuum hose adapter coupling has both a sealing inlet cover and an electrical interlock which initiates power to the motor upon insertion of the vacuum hose. The reduced pressure within the containment chamber during operation of the flow-thru motor urges the elastomeric O-ring into sealing engagement with the cover frame assembly thereby maintaining a hermetic seal. When closing the containment chamber, the lowermost flange 68 of the access panel is inserted behind mating flange 70 of the cover frame assembly, the panel is held against the cover frame assembly and the latch 64 is engaged. The act of latching the access panel causes the O-ring to be urged against the cover frame thereby bringing the O-ring into sealing engagement with the cover frame assembly.

In a further alternative embodiment, the air is directed along a secondary path which causes it to exit from a port in the rear wall of the housing, thereby preventing any exhaust from being directed back into the room and providing for more quiet operation.

In still another alternative embodiment, the entire vacuum cleaning system may be adapted to be flush mounted upon a wall surface and a power cord is then provided for attachment to a standard electrical outlet. In such an embodiment the vacuum hose may be adapted to be stored upon the housing itself.

Referring now to FIG. 5, molded latch 65 is shown. The latch is preferably formed from a nylon or acetal resin. The latch is designed to fit with extremely close tolerance within latch receiving area 62 (see FIG. 4). The lowermost edge 76 of the latch is urged downwardly due to compressive forces developed by resilient ears 78 as they are retained within the cavity 62. This insures positive engagement of the latch with the access panel Operator intervention is thus necessary to deflect the latch upwardly, thereby disengaging the access panel and allowing opening thereof.

To operate the unit one simply attaches the appropriate hose, which is adapted to slidably fit within the hose coupling adapter 74, and activates the motor via the motor actuator means, e.g. a switch provided in the cover frame assembly 50. The front cover frame 50 further includes an electrical power supply receptacle integrally mounted therein.

When incorporated in new construction, an alternative embodiment provides for the inclusion of a branched or T-fitting in fluid communication with the inlet conduit structure. The use of a T-fitting allows for extension of the conduit to a second room or floor. In such an installation a plurality of vacuum hose coupling devices are utilized containing a parallel electrical interlock formed integral with the hose coupling which serves to activate the motor upon insertion of the hose in any one of the plural devices.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

I claim:

1. A self-contained vacuum cleaning system adapted for inclusion within a wall comprising an open-faced housing adapted to be recessed within in a wall, said housing having a containment chamber and an evacuation chamber separated by a partition, a cover frame assembly attached to said housing and closing said housing, a seal formed between said partition and said cover frame, an inlet in said containment chamber for ingress of dirt laden air into said housing, an exhaust in said evacuation chamber for egress of clean air from said housing, an air flow divider in said evacuation chamber directing air flow exiting a vacuum motor assembly through the evacuation chamber and constructed so as to reduce noise producing turbulence, the vacuum motor assembly mounted within said housing, an air filtration and debris collecting assembly connected to said inlet for retention of dirt and debris whereby the vacuum cleaning system is quiet with less vibration during operation.

2. A vacuum assembly of claim 1 wherein said air flow divider comprises a vertical U-shaped curved wall attached to the rear wall of said housing, said exhaust located proximate to the bottom of said U-shaped curved wall.

3. A vacuum assembly of claim 1 wherein said partition includes a motor shroud, said vacuum motor assembly mounted in said shroud, a vibration dampening resilient member confined between said shroud and said vacuum motor assembly.

4. A vacuum assembly of claim 1 wherein an air pervious foam surrounds said vacuum motor assembly to muffle motor noise.

5. A vacuum assembly of claim 1 wherein said open faced housing has a bottom wall, a motor mount connected to said bottom wall, one end of said vacuum motor assembly disposed in said motor mount, a shock absorber connected to said motor mount and positioned between said motor mount and said one end of said vacuum motor assembly.

6. A vacuum assembly of claim 3 wherein said open faced housing has a bottom wall, a motor mount connected to said bottom wall, one end of said vacuum motor assembly disposed in said motor mount, a shock absorber connected to said motor mount and positioned between said motor mount and said one end of said vacuum motor assembly.

7. A self-contained vacuum cleaning system comprising:

an open-faced rectangular housing having a rear wall, two sidewalls, a top wall and a bottom wall, said sidewalls, top and bottom walls being adjacent to said rear wall and perpendicular thereto, said sidewalls and top wall further having a peripheral flange extending outwardly and perpendicularly therefrom, said housing being constructed and arranged so as to define a containment chamber and an evacuation chamber therein;

a cover frame assembly in sealing engagement with said housing further including a containment chamber access panel adapted to sealingly engage said cover frame, a vacuum hose coupling adapted, on a first outer side thereof, for fluid communication with a vacuum hose and further adapted, on a second inner side thereof, for fluid communication with an air filtering and debris collecting receptacle, an evacuation chamber exhaust port;

vertical baffle assemblies positioned in spaced relation to the sidewalls and rearwall of said housing so as to maintain optimum air flow between said containment chamber and said evacuation chamber;

a chamber separating assembly containing, in spaced relation, a supporting grid element, and a motor shroud element, said shroud element having a vibration dampening layer, said chamber separating assembly being supported and positioned by integral members in said baffle assemblies;

said cleaning system characterized by the containment chamber and evacuation chamber being in stacked relation whereby activation of a motor driven vacuum pump situated in the evacuation chamber causes air to be drawn along a straight-through flowpath through the containment chamber causing debris to be collected in said receptacle and said motor driven vacuum pump is isolated from said housing reducing vibration a curved flow divider is attached to said housing, said curved flow divider causes air to be drawn in a curved flow path through said evacuation chamber to said exhaust port whereby turbulence is reduced.

8. The self-contained vacuum cleaning system of claim 7 wherein an elastomeric shock absorber is mounted in said housing for support of said motor driven vacuum pump.

9. The self-contained vacuum cleaning system of claim 7 wherein said open-faced housing and said vertical baffle assemblies are integrally molded.

* * * * *